United States Patent [19]

Blaul

[11] Patent Number: 4,676,261

[45] Date of Patent: Jun. 30, 1987

[54] HOT TANK SPRAY WASHER AND CONTROLS

[75] Inventor: Ronald L. Blaul, Crystal Lake, Ill.

[73] Assignee: Trigent, Inc., McHenry, Ill.

[21] Appl. No.: 731,728

[22] Filed: May 8, 1985

Related U.S. Application Data

[60] Continuation-in-part of Ser. No. 672,145, Nov. 16, 1984, Pat. No. 4,561,903, which is a continuation of Ser. No. 410,589, Aug. 23, 1982, abandoned, which is a division of Ser. No. 275,965, Jun. 22, 1981, Pat. No. 4,433,698.

[51] Int. Cl.[4] ..... B08B 3/02

[52] U.S. Cl. ..... 134/57 R; 134/104; 134/111; 134/200

[58] Field of Search ..... 134/56 R, 57 DL, 58 DL, 134/58 R, 104, 105, 109, 111, 114, 113, 175, 177, 198, 10, 57 R, 200

[56] References Cited

U.S. PATENT DOCUMENTS

| | | | |
|---|---|---|---|
| 3,416,544 | 12/1968 | Paiva | 134/102 |
| 3,542,592 | 11/1970 | Zweig | 134/1 |
| 3,857,002 | 12/1974 | Lay et al. | 134/58 DL X |
| 4,038,155 | 7/1977 | Reber | 134/57 DL X |
| 4,101,340 | 7/1978 | Rand | 134/109 |
| 4,170,488 | 10/1979 | Norman | 134/10 |

*Primary Examiner*—Harvey C. Hornsby
*Assistant Examiner*—Frankie L. Stinson
*Attorney, Agent, or Firm*—John W. Gaines

[57] ABSTRACT

Hot tank washer for cyclically repeated temporary intervals of spray cleaning operation, and controls therefor automatically coordinating operation of the system initiating switch, a heat interruption switch, and a door switch with one another and with other system operations. The heat interruption switch inherently puts the hot tank heating on standby momentarily with no power, incident to the user operating the spray system initiating switch; the spray system comes on under full power, incident to, and only contingent upon, the hot tank heating being first put on standby with no power; the spray system and a washer defogger system are automatically secured from operation, incident to the door switch being operated by opening of an access door allowing new work to be put into the washer.

23 Claims, 11 Drawing Figures

W
P

HOT TANK SPRAY WASHER AND CONTROLS

This case is a continuation in part of co-assigned U.S. patent application Ser. No 672,145, filed Nov. 16, 1984 now U.S. Pat. No. 4,561,903, itself a continuing case of co-assigned Ser. No. 410,589 which was filed Aug. 23, 1982, which is now abandoned, and which is a division of co-assigned U.S. patent application Ser. No. 275,965 filed June 22, 1981 parent U.S. Pat. No. 4,433,698 relating to a parts cleaning system.

This invention relates to control apparatus for such a cleaning system, especially for a hot tank spray washer employing the scouring action of a concentrated high pressure spray of a heated liquid solvent effective in the removal of oils and greases. Specifically, the so-called soils to be removed are ones found on automotive and industrial parts and commonly include, besides the oils and greases noted, the usual varnishes, soft carbons, and buffing, polishing, stamping, lapping, and drawing compounds susceptive to pressure washing.

More particularly, the control invention hereof facilitates the machine washing, by eye through a work window, of parts under high pressure by means of a hot liquid supply tank, a tank-supplied hand directed spray nozzle, and an enclosing chamber containing the parts in a manner whereby the mist-laden spraying zone in which the parts are sprayed by the nozzle is closely confined within the enclosure so as not to expose the operator or the outside environment to the liquid runoff of solvent, or the sprayed particles thereof, or to solvent steam or rising vapors. The internal atmosphere, continually being recycled by forced circulation to keep air clear in the chamber, is restricted thereby to its same closed confines as the spraying zone.

Such prevention of escape of both atmosphere and solvent enables recovery of all of the air and all of the solvent so as to be cleared and re-used, without being lost to some extent to the outside and, undesirably so, introducing contamination thereto to that extent. The pressures and flows from the fluid forces present and the steaming temperatures involved are evident control matters to be reckoned with, and so of course are the consequent power requirements.

Such desiderata as the foregoing entail, as will be seen according to the practice of my invention, first keeping down the vapor concentration by defogging the chamber air, second simultaneously defogging the work window through blanketing same by the defogged air as recycled, third controlling the power requirements by a careful limit on the peak demand of the machinery for heating and forced flow, and also controlling the power so that the fluid forces are generated when needed and otherwise rendered inactive and incapable of creating any interference with the ongoing process.

The concern to prevent atmospheric and other environmental pollution and to conserve natural resources by continual re-use of the internal atmosphere and all solvent is especially important because of ecology considerations.

Washing methods in accordance with practice in the past have, for instance, involved such machines as are utilized by the repair man who frequently washes parts, an automobile mechanic, for example. These machines provide an open front for his ready accessibility with his washing, also a hand brush, and a slow running, steady solid, large stream usually of a petroleum solvent with which he rinses off a part, after a good pre-soaking and brushing, usually. The rinse-off is manual, accomplished by directing a hose-carried hand nozzle provided on the parts washer, and the rinse solvent is continually filtered and admitted to a pump on the machine for constant re-use by being recirculated back to the hand nozzle.

By reason of convenience and expediency, it is therefore the practice for the repair man to wash parts openly in the washer and usually bare-handed, and in no way protecting his skin surfaces, clothing, and breathing from the drawback of direct exposure to solvent stream, splash, harshness and irritation, and air-borne fumes, and in no way protecting outside surroundings to the washer from that same drawback. The pre-soaking and hand brushing noted naturally represent added drawbacks due to introducing added steps and consequent delay and manual effort. But admittedly the usual washer in the shop, because the parts therein after their pre-soak receive at best an easy hand-rinse under the hose, is not beset by any problems and complications attendant with fluid heating and forced flows requiring control equipment to limit their activity and coordination as earlier discussed, or attendant with the peak power requirement limits likewise considered.

It is an object of the present spray washer and control equipment invention to materially reduce or substantially eliminate the foregoing drawbacks and the problems and complications mentioned, and other disadvantages of parts washing as just described. Of lesser analogy to this washing procedure for the repair man, some background patent material which can be noted includes, along with the publication Abstract Number PCT/CH80/00029 priority date 3/26/79 published 10/2/80 disclosing a washer for hands with air circulation of relevance, a certain U.S. Pat. No. 4,170,488 disclosing a continuous parts washer with cleaner and air recycling of relevance, and most especially the three U.S. Pat. Nos. 2,576,008 to Gladfelter disclosing a glass-fronted sluriator with work gloves, a blast gun nozzle, and an exhaust blower of relevance, 4,101,340 to Rand disclosing a nail degreaser and drier chamber with air exhausting in part in its path by blowing directly out into the atmosphere and flowing in part in an air recirculation path of relevance, and 3,542,592 to Zweig disclosing in the environment of a glass-fronted chamber containing inside work gloves and spray equipment for spraying off ink from an assembly line of printing plates, the attendant power circuits for the equipment and a front power panel of relevance, mounted below the chamber as illustrated.

A more specific object consists of one or more steps my equipment inherently provides to program the worker's operation of a hot tank spray washer which comprises a closeable pump circuit including a liquid-supplied electric pump therein having a liquid output and a spray cleaning nozzle in the output, a normally closed heater circuit including an electric hot liquid tank therein for supplying the electric pump, power means for operating the pump and heater circuits in alternation comprising a circuit including a relay coil and two control switch means in series connection thereto comprising first and second switches, a power load circuit including an electric blower and a third switch in series connection therewith to control the electric blower, said second and third switches individually closeable by operator-operation, said electric blower having a clear air output which provides a window blower nozzle for delivery of a blanket of the clear air, and a windowed spray chamber for housing the window blower and spray cleaning nozzles having an access door closeable in the path of the nozzles to confine all blowing and overspray to the chamber, including a step which, incident to the movement occurring with the operator's closure of the third switch to the blower to pressurize the window blower nozzle, is automatically to close the first of the two switches in series connection to the relay coil, preparing the relay circuit for operation of the relay coil, another step which, incident to relay movement occurring with the operator's closure of the second switch completing the operating circuit to the relay coil, is automatically to open the heater circuit interrupting further consumption of power in the electric hot liquid tank, a further step which, incident to the relay's movement occurring when it opens the heater circuit, is automatically to close the pump circuit to pressurize the spray nozzle, and an additional step which, incident to movement occurring by the operator opening the door from blocking the blowing and overspray from the inside of the chamber, is automatically to interrupt further consumption of power in the electric blower and electric pump circuits, depressurizing the window blower and spray nozzles.

Within broader purposes of the invention, my objective is to provide a fully powered, self contained machine enabling the operator in the normal electrified residence or industrial or automotive shop to simplify and speed up the hand washing of the volume of his automotive and industrial parts which need cleaning and adapted, for all the machine's power requirements, to be simply plugged into the usual electrical wall outlets convenient and regularly available throughout.

Further features, objects, and advantages will either be specifically pointed out or become apparent when, for a better understanding of my invention, reference is made to the following description taken in conjunction with the accompanying drawings which show certain preferred embodiments thereof and in which.

Figures 1, 2, 3, 5, 6:
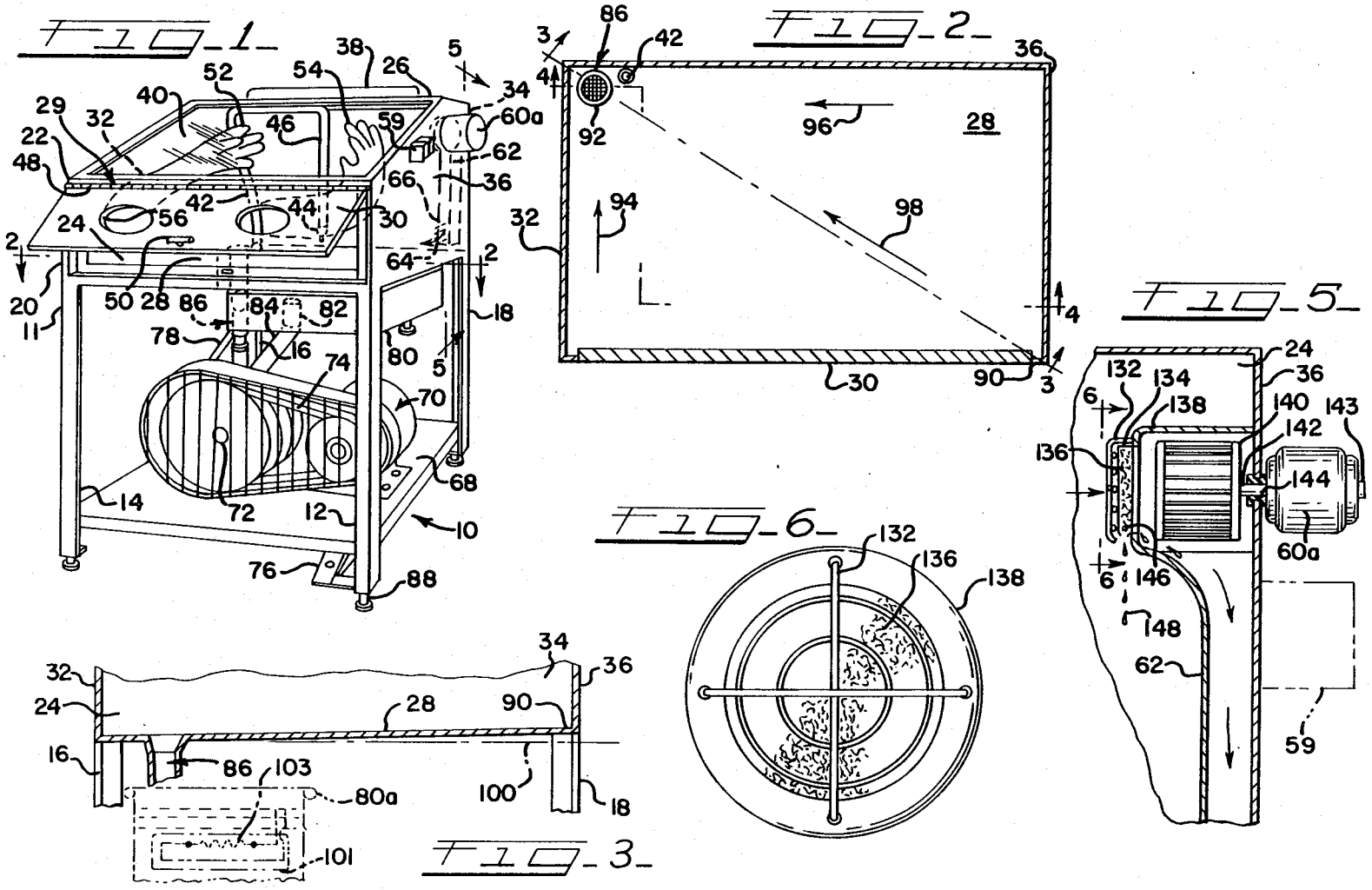
FIG. 1 is an isometric view of the washer as fully assembled, with power and control equipment, a floor stand therefor, and a cleaning machine cabinet atop the stand and embodying a blower conduit therein, two recycling systems thereof, and other principles therepresent according to the invention.
FIG. 2 is a cross section, in plan view, of the machine's floor pan as taken along the section line 2—2 of FIG. 1.
Figures 4, 7, 8, 9:
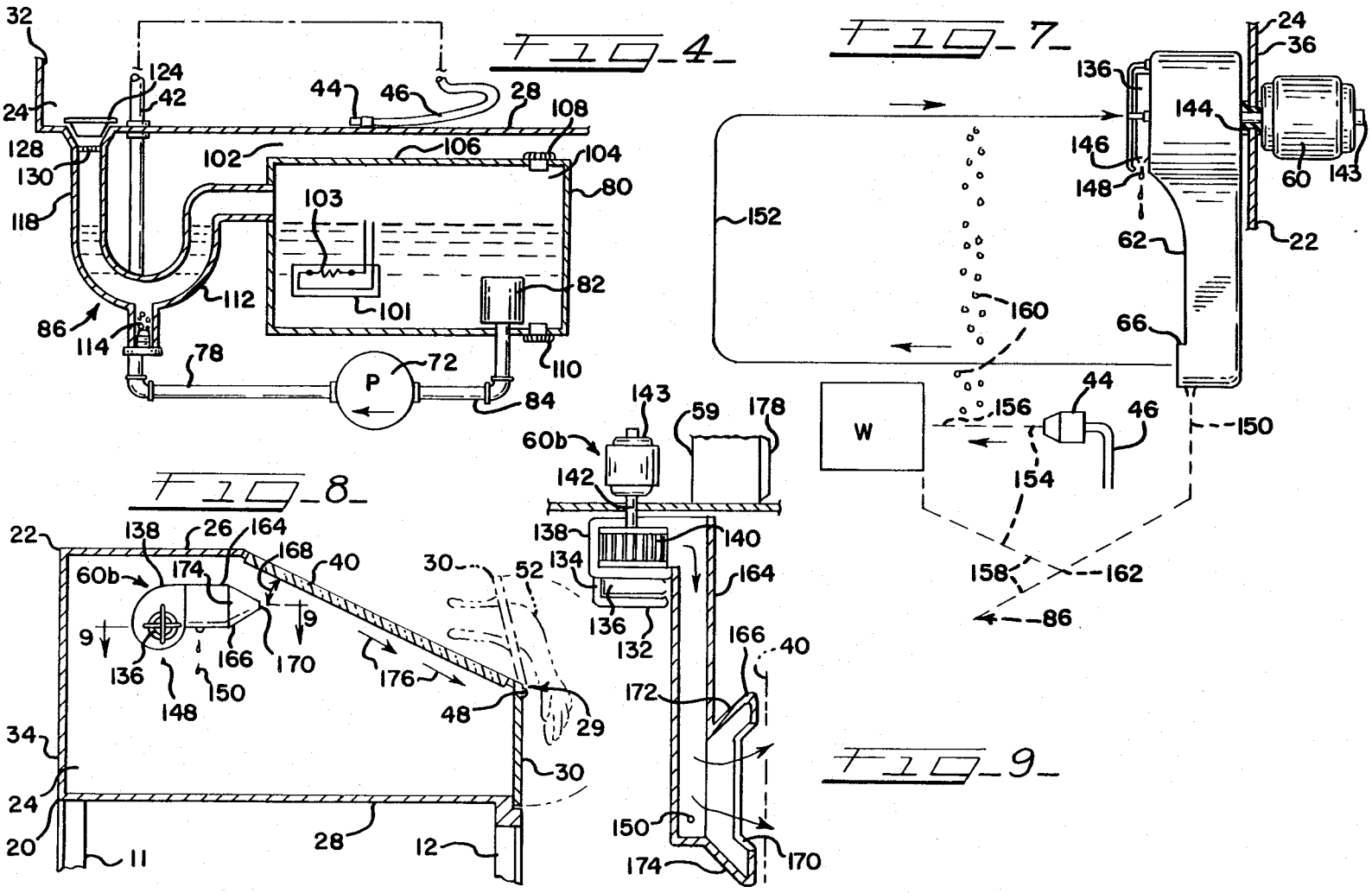
Figure 11:
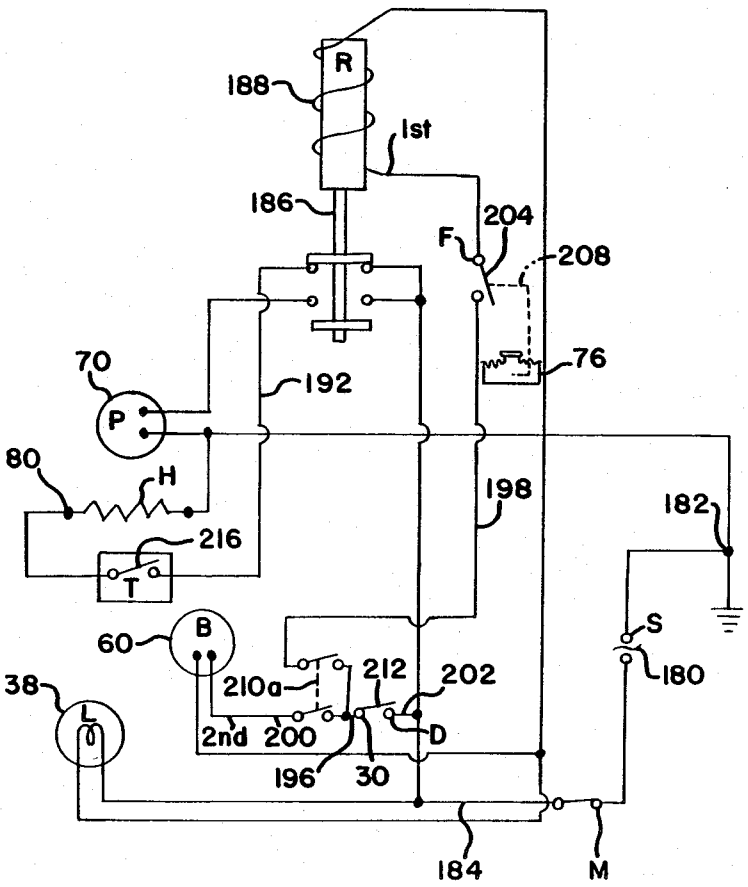
Figure 10:
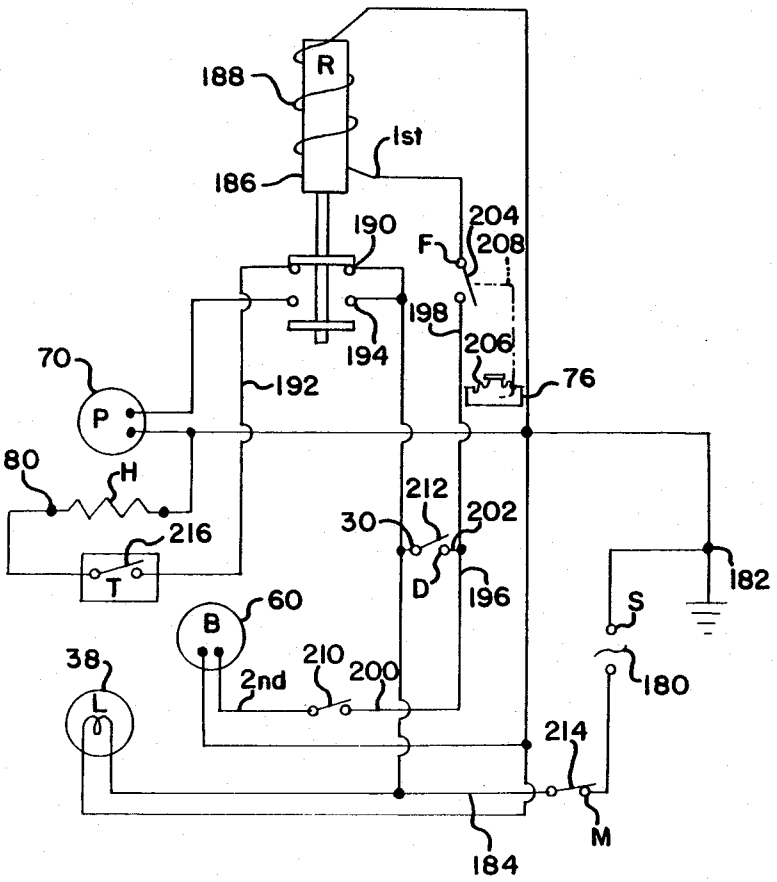

FIGS. 3 and 4 are cross sectional views in front elevation of the floor pan with drain to hot tank storage and as taken along the respective section line 3—3 to show schematically a phantomed-in heated reservoir pail and section line 4—4 showing the actual drain trap and heated reservoir tank;

FIG. 5 is a cross sectional, front elevational detail showing a blower conduit as configured in the vertical one of its forms, and taken along the section line 5—5 of FIG. 1;

FIG. 6 is an elevational face view of the inlet filter carried by the vertical form of blower conduit, as viewed in the direction indicated by the section line arrows 6—6 in FIG. 5;

FIG. 7 is similar to FIG. 5, but is further supplemented with schematic additions indicating solvent spray crossover joining the closed path of circulation of air by the blower conduit, and indicating agglomerate crossover joining the closed path of pumped solvent circulation as soon as the air path loses its entrained vapor being filtered out and agglomerated in the inlet filter;

FIG. 8 is similar to FIG. 6, additionally thereto showing a blower conduit, as configured in the horizontal one of its forms, in more complete detail and being supplemented for further details by FIG. 9 as taken along the section line 9—9 in FIG. 8;

FIG. 10 is an electrical schematic showing of the automatic power control circuitry coordinating the two recycling systems provided in the machine; and FIG. 11 is an electrical schematic diagram showing a modification of the FIG. 10 circuitry.

More particularly in the drawings, a hot tank spray washer 10 is shown in FIG. 1 having a floor stand 11 supported on four legs 12, 14, 16, and 18 and supporting the machine 20 for cleaning parts. The machine has a six-sided, vapor confining cabinet 22 affording a fully enclosed spray chamber 24 therein and including, along with the spaced apart sealed top wall 26 which is relatively foreshortened and floor pan wall 28 therebeneath, a continuous series of side walls 29, 32, 34, and 36 joining same for totally confining the air contents contained by the chamber 24.

The top wall 26 has structure including a light fixture 38 equipped with one or so straight fluorescent tubes for clear view by the operator of work in the chamber 24. In that connection, what I provide at the front side actually consists respectively of pivotally-joined vertical lower and glassed, diagonally disposed, upper panels together forming the front side wall 29 in extent, respectively upright transversely to the adjacent floor pan 28 and slanting upwardly and rearwardly to a point of attachment between the top end of the diagonal upper front panel and the relatively foreshortened top wall 26.

Specifically, the lower panel of the front side wall 29 is formed mainly by a sealed door 30 secured by a horizontally disposed piano hinge 48 at the top edge so as to open outwardly and upwardly to admit work through the door opening in the panel into the chamber 24. A transparent plastic window 40 of Plexiglas or $\frac{1}{4}''$ safety glass is inset at a console viewing angle in parallel in the diagonal upper front panel of the front side wall 29.

A high pressure hose 42 which passes through the chamber 24 is secured inside the cabinet 22 so as to hang down at or near the center of the underside of the foreshortened top wall 26 and supplies a spray nozzle 44 carried at a free swinging, depending terminal portion of the hose 42.

One or more door handles 50 at the front of the door 30 control a lock carried by the door to keep it tight against door edge seals when the door closes. Omitted from appearing are the door seals because of the small scale of the showing, and a sealed door switch hereinafter referred to is not shown for the same reason, the seals and switch being standard ones with moisture resistance.

Left and right, leak-proof glove box gloves 52 and 54 are in the chamber sealed to the inside of hand holes 56 and 58 in the door, allowing the operator access for his hands and forearms into the chamber 24 at a point below the viewing window 40. The operator stays dry because of the door and because of the impervious arm-length work gloves 52 and 54, he being afforded no alternative to wearing the protective gloves.

The side wall 36 which is at the right end of the cabinet 22 as viewed in FIG. 1 carries adjacent one another an attached power control box 59 on the outside and also an electric blower generally indicated at 60*a*. The outlet of the blower has, on the inside starting at the top of the cabinet, a vertically disposed run of conduit 62 forming a blower tower, and the tower affords continuous internal circulation of the chamber atmosphere. Specifically, it reintroduces the atmosphere by discharging at the bottom into the chamber downwardly and at right angles through a vaned blower nozzle 64 in the blower output communicatively transverse to the tower and medially directed as part of the air circuit desired.

The stand legs 12, 14, 16, and 18 support, at a slight distance above the floor, a generally horizontal base platform 68. The platform 68 has bolted thereto a switch-operated electric pump 70 having the high pressure pumping component 72 thereof connected by shaft or by a V-belt 74 as illustrated to its drive motor. The drive motor is operated through a pneumatically actuated drive switch by a remote air capsule pedal 76 reposing on the floor, which frees the hands of the operator by affording him foot control to start and stop initiation of the spray cleaning operation.

More specifically, a high pressure conduit of the pumping component 72 connects the pump output with a hose fitting to the spray nozzle hose 42 positioned in chamber 24. After the operator directs a nozzle 44 on the hose at a part to be cleaned, he presses his foot down on the pedal 76, and the nozzle 44 pressurizes and starts spraying.

In the upper part of the floor stand 11, a hot reservoir tank 80 is carried on a level spaced at all points a predetermined safe distance below the bottom of the floor pan wall 28 which serves in closing off the bottom of the chamber 24. From a filter supported within the tank 80, an interconnecting suction conduit 84 leads to the inlet side of the pumping component 72.

Suitable drain line structure 86 interconnects the hot tank 80 and the floor pan wall 28 for handling drainage in the way it collects in the latter. Each of the legs on the stand 11, such as the right front leg 12 which is typical, stands on a threadedly adjustable foot 88. In installation, the foot 88 is threadedly extended to make the leg 12 slightly longer than a pair of legs 14 and 18 of matching lengths, whereas the left rear leg is adjusted to become the shortest, all solidly on a level floor.

FLOOR PAN DRAINAGE—FIGS. 2, 3

The unequal leg adjustment beneath the floor stand 11, just described but hardly preceptible to the eye, produces a definite slope in the floor pan from a high point at the right front corner 90 down to the low point 92 connected to drain structure 86. The true horizontal plane appears at 100 in FIG. 3.

So gravity directed runoff all converges toward and is collected by the single drain, all without allowing runoff to puddle or otherwise accumulate before going directly down the drain.

A reservoir pail 80*a*, shown in FIG. 3 without the attendant cover necessary, schematically appears in phantom to represent the electric hot tank and includes therein a sealed heater 101 immersed in the tank liquid and containing an electrical resistor element 103. As so embodied, the pail 80*a* accommodates to a straight vertical drain pipe. For a quick change of fluid, the minor effort involved is simply to lift off the pail cover, remove the pail, dispose of spent fluid, refill with a fresh water-mix of powdered detergent, for example, and replace the cover.

FORCED LIQUID CIRCULATION—FIG. 4

In their locations on opposite vertical sides of the air space 102 by which they are kept forcibly separated, the chamber 24 at the bottom is maintained sealed apart by the wall 28 and the reservoir chamber 104 at the top is maintained sealed apart by the impervious reservoir cover 106. A fill opening cap 108 tightly closes off a fill opening in the cover and a drain plug 110 tightly closes off a drain opening in the bottom wall of the reservoir tank 80. The liquid-proof tank heater 101 with its resistor coil 103 therein is shown down in the liquid of the tank.

In one preferred embodiment of the structure 86, a drain trap 112 is provided therefor of familiar plumbing U-shape; in the usual way, the legs of the trap hold it continually full of liquid. At the lowest point in the bend therein, the trap 112 has a depending vertical extension 114 which, when unplugged as provided for at the bottom, allows metal chips and an accumulation of grit and other particles which sink down out of the liquid to be periodically removed from the liquid system. A strainer cup is illustrated at 124.

All liquid which the pump 72 causes to be discharged by the nozzle 44 eventually makes its way back from the chamber 24, thence through the drain structure 86, and into storage in the tank 80 so as to be again available for the electric pump 72. A throat strainer is shown at 130.

FORCED INTERNAL ATMOSPHERE CIRCULATION—FIGS. 5, 6

A wire grille 132 covers the inlet 134 to the tower 62 which, on the inlet's outer side, carries a liquid agglomerating filter 136 behind the grille 132 and which, on the inlet's inner side, carries the communicating tower scroll housing 138 containing the blower rotor cage 140. A motor shaft 142 passing from a blower motor 143 through a shaft seal 144 in wall 36 supports the blower cage 140 for high speed rotation causing the internal atmosphere of the spray chamber to be drawn through the filter 136 in the direction indicated by a suction arrow. The blower cage then forces the air to blow down the tower 62 in the vertical direction of the arrows shown therein.

Cleaning-liquid fog is extracted from the chamber's internal atmosphere by the agglomerating filter 136. A good part of the thus separated liquid in the filter agglomerates as droplets or drops in a drip hole 146 at the bottom of the filter 136 so as to fall in the chamber in a side path it takes which I indicate generally at 148 and which I shall designate the 2*d* crossover path.

The remainder of the agglomerate spills out the face of the filter 136 on the inner side so as to go down the inside of the blower tower 62 in a 3*d* crossover path generally indicated at 150, either by free fall as drops or droplets or by dripping or running down along the inside wall of the tower and out through a drip hole.

CROSSOVER—FIG. 7

Although the just preceding discussion of air-blower forced circulation was presented separately and independently from a prior appearing discussion of the pump forced liquid circulation, the stringently confined paths of these two closed circulation systems establish cooperation and have three common portions contained within the confines of the spray chamber 24. The essentially air-tight integrity of the surrounding cabinet fragmentarily shown in FIG. 7 at 22 will insure a leak-free internal air path schematically indicated at 152 and a leak-free liquid path schematically fragmentarily indicated at 154.

High pressure pump spray 156 along path 154 can be selectively directed by the gloved hands of the operator at the work W supported in the chamber 24, for example, directed at the housing of an automotive power steering pump requiring grit and grime and an oily film to be stripped off. The cleaning liquid runof 158 along sloping path 154 carries with it the impact-dislodged grit and grime plus the solute therein from the clinging oil and dirt film dissolved by the liquid off the work W.

Splash and splatter of the extremely fast moving spray particles being stopped by the work W produce continuous mist from the cleaning liquid which, in a common portion of travel shared by the circulating liquid and air, transfers as a fog in a 1st crossover path 160 into entrainment in the chamber's circulating internal atmosphere.

Simultaneously, continuous agglomerate being recovered by the filter 136 is in part following the *2d* crossover path 148 and in part following the *3d* crossover path so that the two parts can combine and together be reunited with their parent stream of liquid runoff 158 at a floor pan juncture schematically appearing at 162. This common portion of travel shared by the circulating liquid and air makes possible the complete return for re-use of all cleaning liquid applied, and as one body it enters and pours down the drain line structure 86.

In the ordinary case, the continual stripping, by filtration, of the rising mist from the air almost as soon as it forms therein never allows the vapor concentration to run high enough for fogging over the operator's viewing window 40 in the console, not shown. However, problem cases can arise where a nonflammable hotter cleaning spray is desired as with a detergent-action cleaning powder in water, or where the cleaning liquid employed is some petroleum based solvent having, even without heating, an inherently high vapor pressure. Further means of preventing the glass from steaming over from the water, misting, and other fogging are provided in the practice of my invention.

MODIFIED EMBODIMENT—FIGS. 8, 9

Illustrative of one such means is the modified embodiment of the invention as shown in these figures. Within the environment of the machine 20 already described and equipped with a floor stand 11, the modification occurring is made in respect of an electric blower **60*b* to enable the machine to perform with normal effectiveness even under the most stringent operating conditions of window fogging. In place of the run of air conduit forming a vertical tower as before, I provide a medially directed run of conduit 164 connected in the blower output extending in parallel closely adjacent to, and partway of, the chamber top wall structure 26 lengthwise. A horizontal window blower nozzle 166 is connected in the blower output communicatively transverse to the horizontal conduit 164 and laterally directed in its plane to impinge at an acute angle of incidence 168 beginning at a top inside portion of the window inset 40**.

The nozzle 166, formed with a long thin slot 170 in its discharge terminal, has outwardly flared sides 172 and 174, diverging in the direction of clear air flow toward the thin horizontal discharge slot so as to direct the latter, suitably diffused, in a thin, slot-wise widening blanket of forced scrubbing contact transverse to the window 40. The resulting diagonally downward path of lateral air flow is indicated by the direction arrows 176. The power control box 59 is shown in FIG. 9 with a vertical switch panel 178 at the front.

The agglomerate drip follows, as before, the *2d* and *3d* respective crossover paths 148 and 150.

For a console angle window setting of about 45° from the horizontal, the blown clean air path takes a forced turn likewise of 45° to follow the arrows 176. So under the impulse of the powerful blower motor 143 as herein provided, inertia of the moving air stream in resisting the turn creates an exaggerated impact spreading across the underside of the window 40 and forces it to be cleared off.

Although the scouring effect is akin to action expected from an automotive defogging and defrosting nozzle, the effect is moreso here because the cleaning-liquid fog-removal in this instance changes the actual character of the air being blown; it is clear and is ridded of its fog contents. So the window surface is being dried by the scrubbing thereof with an undistorting, forced blanket of processed drying air, as well as being undistortedly air-curtained off from having a stagnant layer of foggy air settling in and misting up the underside.

CLEANING LIQUID

Cleaning liquids of a wide assortment are satisfactory for use in the present machine, and they commercially vary in composition according to the character of the industry in which they are utilized. In the bakery industry for example, a low sudsing solution of detergent in hot water under the strong spraying power hereof can readily scour off the baking pans.

When the reservoir of the machine is tanked with a petroleum based cleaning solvent for the oils and greases, the reservoir tank will sometimes be equipped with a thermostat with an appropriately low temperature setting for the heating coil, or more likely will have no heater or thermostat equipment at all. It is essential that the petroleum constituent have a high flash point, and 104° or a higher value such as 140° F. is not uncommon in the petroleum based solvents found in washers in the usual service and machine shops and repair garages. In many, the brand used currently and found altogether acceptable is Stoddard petroleum solvent produced by Safety-Kleen Company. Another highly suitable proprietary brand, made available through its distributors in many if not most states within the continental U.S.A. by one maker of assorted cleaning products, Graymills Corporation, Chicago, Ill., is its GM Super Agitene or GM Super Agitene 141 (FP 141° F.) safety solvents both of which are familiar to the trade.

Low bubbling soap/detergent solutions are preferred, particularly with the hot tank installations, and can be effectively applied by the machine to the different parts requiring washing in various shops or the like. A powder GM 571 alkaline cleaning detergent of Graymills in a water mixture heats stably to 180° F. and performs well in the machine, over an extremely wide range of cleaning applications.

Any of the effective liquids have the tendency under impetus of the high pressure impact to create a "wet" atmosphere, a problem even with petroleum based solvents at room temperature and surmounted herein. So positive internal air pressure cannot be allowed to develop because of the further complication of an escaping fume problem. The present machine never forces out fumes into the air; no pressure differential develops from inside and there is no net gain or loss in volume because all fluid taken from the hot tank returns to it and all air expelled by the blower is returned, eventually and without escape.

AIR FILTER

The specifications for the agglomerating filter are not rigid in the least; it works to full effectiveness as soon as all surfaces are wetted by the liquid and in one satisfactory working form it was simply a ¼" thick, 5" diameter closely knit pad of thin, chemically inert fibres. The film on the fully wetted surface areas thereof is continually fed by impacting fog particles, such as from the saturated steam of the usual water-mixes.

Fiberglas fibre is suitable for the knit pad material and so is zinc coated steel mesh, particularly when a petroleum solvent solution is being filtered out. For better efficiency the thickness can be increased to ½", and further satisfactory materials include foam rubber, paper filter material such as found in the air intake cleaner and silencer for automobiles, foam polyurethane material, and aluminum fine mesh.

OPERATION

The nature of the machine's operation is for cyclically repeated temporary intervals of spray cleaning of one object, thereafter to be exchanged for the next object to be cleaned.

As an example of the level of operating pressure I am referring to as a high pressure operation, the pump discharges at 1,100 psi in one generally satisfactory embodiment which has been built of the invention. In the main, pumps matched in capacity and outlet pressure to the nozzle to be employed would discharge in the broad range of 400 psi to 2,000 psi, whereas the preferred operating range for pressure delivered to the nozzle would be somewhere approximately from 400 psi to about 1,000 or 1,100 or 1,500 psi.

Because of the stripping effect of solvent herein under the stated discharge pressures, no pre-soaking and no brushing are ordinarily required. With the part in or at least manipulated by one gloved hand and the nozzle in the other, the operator exposes the interior and exterior surfaces of the part to direct force of the spray so as to dislodge the loose and clinging matter and dissolve deposited layers, films, and coats such as lubricant of which the part is to be ridded. The cleaning can be for metal chip removal, intricate passages, blind holes, tools and dies, and pneumatic and hydraulic cylinders.

Full force spraying will continue as long as the operator's foot presses the pedal 76.

In a reversal of all steps of the foregoing procedure, the operator releases the pedal, extricates his hands and forearms from the gloves, opens the door and, among other things, extricates the completely spray cleaned part. If a caged ball bearing happens to be the part and the selected cleaner a petroleum solvent, I insist in my own operations that additionally the part then be washed by hand in regular hot water and suds, rinsed off, and dried, such bearing for instance thus carrying with it no residual film of petroleum based solvent to interfere with the surfaces thereafter directly establishing intimate wetted contact with lubricant when being recoated with bearing grease for reinstallation.

The preferred practice of the operator in removing his hands and forearms, when in the work gloves extending into the machine, is lightly to grip the gloves' fingers, and withdraw the gloves conjointly for a distance. The outwardly flaring arms of the gloves thereupon convolute, allowing them to invert a portion of their larger diameter open ends. Afterwards, when the operator releases and removes his hands and wrists independently from the gloves, he then inherently by upswinging the door 30 overcenter to a diagonally rearward position folds the gloves at least partially out of the way of the access opening. FIG. 8 depicts a phantom showing of the left glove 52 as representative, with its telescopically inverted arm portion folded beneath the door 30 in the mutual storage position taken by the gloves. The glove fingers depend a distance below the door 30 and door opening, but only a short way because of the telescoped foreshortening of a substantial length of the glove 52.

A pump particularly well suited to the practice of this invention has not only the characteristic of delivering the referred to continuous high pressure to the spray nozzle, but equally the characteristic of delivering a continuous high rate of flow as compared to the usual low capacity pumps of hand washers for parts in general. A piston type electric pump developing ¾ hp under single phase 60 cycle current at 115 volts proves altogether adequate. Volume-wise, a pump capacity approximately between 2.2 and 3.5 gallons per minute continuously delivered under high pressure has proved satisfactory for the high rate, nozzle discharge velocities required herein. And it has been found here that that volume of spray flow can be altogether adequately supplied from a relatively moderately sized reservoir sometimes of 10 gallon capacity, but generally 5 gallons is of sufficient size.

CONTROL CIRCUITRY—FIG. 10

Power control apparatus is provided herein to coordinate the system of components appearing in this circuitry figure, comprising the schematically shown electric hot tank 80, electric pump 70, electric blower 60, and a source of electric power 180 grounded at the side 182 thereof.

For that purpose, a power line 184 is connected to the live side of the source 180 for energizing the control switches next enumerated which are seen to be included in the operating switching circuits. A circuit-transfer or relay switch 186 provided with an electrically operating relay coil 188 includes a set of normally closed contacts 190 electrically connected to power line 184 and connected in a load circuit 192 to the electric tank 80, and a set of transfer contacts 194 electrically connected to the power line and connected to the electric pump 70.

A control supply line 196 has circuit connections at one side connecting in respective first and second circuits 198, 200 each of the relay coil 188 and electric blower 60, and providing at the other side in respect of the coil and blower a common supply connection 202 therefor to the power line 184. A drive or so-called floor switch 204, physically located in the machine so as to be about two feet above floor level, not shown, is remotely operated pneumatically by the air capsule pedal 76; from the hollow interior which is closed at the top by a convoluted rubber diaphragm 206 on the pedal 76, the latter's capsule is connected by an air hose 208 to apply pressure or not in closing or opening the drive switch 204. Water on the floor such as mop water cannot short out the switch 204.

The switch 204 is connected electrically in series in the first circuit 198 for operating the relay or operator coil 188 to limit the peak power demand of the system. The switch operates by, respectively in switch-closed position, deenergizing the electric tank 80 during cyclically repeated temporary intervals when the electric spray pump is operating under power, and otherwise deenergizing in switch-open position the electric pump 70 when the electrical supply resumes through the normally closed relay contacts 190 to the electric tank 80.

A blower switch 210, preferably closed by the operator before he starts applying the foot switch 204, is connected in the second circuit 200 so as to be electrically in series with the electric blower 60, with the intention that the latter will be energized at all times at which the electric pump is energized. A safety switch 212 on door 30, connected electrically in series in the common supply connection 202 for the relay and blower, acts as a door switch responsive to access door operation for automatic circuit interruption so as simultaneously to deenergize the electric blower and pump in a door-open switch-open relation and vice versa in the door-closed switch closed relation.

The spray chamber light fixture 38 is connected in common with the sets of relay contacts 190, 194, so as to be electrically in parallel therewith to the power line 184. A main switch, shown at 214 in closed position, is connected electrically in series in the power line 184 so as, simultaneously when closed, to switch-on the chamber lights and, through the normally closed relay contacts 190, switch-on the electric tank for heating, and vice versa when open.

Finally, a thermostat switch 216 is connected electrically in series in the load circuit 192 to the electric tank 80 for limiting the peak electrical demand automatically in response to any hot cleaning liquid while at or above a predetermined cleaning temperature.

By inspection, it can be seen that when one step of operation acts in the circuits, another step forthwith reacts in its own operation. Thus concomitant with movement of closure of the operator's system initiating foot switch 204, the step brought about is that the upper relay contacts 190 automatically open interrupting further consumption of power in the load circuit 192, thus putting the electric tank 80 on standby. That is, the switch 204 is the second or last of the switches 212, 214 (circuit preparing switches) to close, thus to complete the lst or relay coil circuit.

Concomitant with this movement of opening the tank heater load circuit 192, the step brought about is that the lower relay contacts 194, always forced to act with but after in effecting their own response, automatically close the pump circuit allowing power to the electric pump 70 to be put on the line.

And always, concomitant with movement of opening the door 30, the step brought about is simultaneous interruption of power automatically in the two electric blower and pump circuits depressurizing the window blower and spray nozzles to keep from expelling any inside products to contaminate the outside.

And finally, concomitant with a sensed rise of tank temperature to the predetermined thermostat setting, the step brought about is automatically interrupting all power in the tank load circuit 192 thus limiting peak demand of power required in the other circuits of the system.

CIRCUITRY MODIFIED—FIG. 11

The modification to connecting up the control apparatus as shown here does not change the relation of components in the system bearing the same designations and reference numerals just considered, namely, tank 80, pump 70, blower 60, source 180, line 184, switching relay 186, coil 188, contacts 190, 194, circuit 192, switch 204, pedal 76, hose 208, switch 212, fixture 38, and switch 216.

The purpose is to insure against the machine going into operation to clean parts without the air system being in operation inside, already cleaning the air and clearing the work window. The blower switch I therefore provide consists of a gang switch **210*a* with conjointly closing upper and lower contacts having circuit connections at one side connecting in respective first and second circuits 198, 200 each of the relay coil 188 and electric blower 60, and having at the other side with respect to the coil and blower a common gang switch connection 202 to the power line 184. Again, the switch 212 opened by door 30 is electrically in series in the common gang switch connection 202 of the control supply line 196**.

Because the power control box 59, not shown, of all embodiments carries a switch panel 178 pertinently marked simply at one point "Blower" or "Fan", the relevant switch panel switch **210*a* of this FIG. 11 embodiment causes the operator without conscious effort to prepare the relay circuit 198 incident to pre-operating the blower. That is, he inherently or automatically closes the first one (upper contacts of 210*a*) of the two switches consisting of uppers and foot 204, which are in series connection to the pump-starting relay coil 188**, incident to his intentional movement of closure of the blower or fan switch as so selectively designated.

Hence the blower is always on and running and therefore the nozzle circuit 198 is always "prepared" at **210*a*, before the operator is rendered capable of completing the nozzle circuit 198 with his foot switch 204 to turn on the pump 70 by means of the relay 186**.

The electrical coil 103 of the resistance heater provided in the hot tank 80 nominally draws, in one physically constructed embodiment of the invention, 1,000 watts power on single phase, 115 volt, 60 Hz current, and is thus compatible with the already described electric pump in suitability for a common 115 volt power source.

A resistor coil of the size just stated meets the requirement for a so-called fast heatup, bringing the 5 gallon tank from an ambient of 68° F. to the minimum spray temperature 120° F. in one hour. The temperature is somewhat flexible, selectable in the approximate range from 120° to 180° F. and the tank thermostat often selected can be expected to have a setting of about 140° F.

The nozzle requires pressure from the pump only intermittently, never as much as for a full minute. Off time, during any spray cycle, lasts about ten seconds to allow the operator to turn the part around or over to continue the spraying. The complete cycle per part, of all off and on times in the aggregate, will rarely last as long as five minutes. Thereafter, the pump stays idle to change parts.

It can be seen that, with the foregoing use of tank heating and nozzle pressurization occurring only at short, always spaced apart intervals, there is no problem to the liquid heater for steady temperature maintenance in the tank.

While in practice the electric pump 70 will draw 11 or 12 amperes, surging up to about 17 perhaps in a momentary hardly perceptible spike, and the heater coil will draw 12 to 13 amperes, the usual shop circuits providing 115 volts are easily accommodated to; the latter are breakered or fused for 15 or 20 amperes and so are never overloaded by the present machine, which thus offers universal adaptability and application and installation with no need for higher voltage outlets or special wiring.

Variations within the spirit and scope of the invention described are equally comprehended by the foregoing description.

What is claimed is:

1. Control apparatus for a hot tank spray washer controlled for cyclincally repeated temporary intervals of spray cleaning operation and characterized by a glassed cabinet which includes an enclosed spray chamber and presents a front side threrat, said cabinet opening at said front side for access to said spray chamber, and provided with a safety switch responsive to the cabinet being opened, an electric hot liquid supply tank and an electric spray pump supplied thereby to provide hot cleaning liquid for sparay washing of which a characteristic is a rising fog in the spray chamber, an electric blower with input in which a fog separator is provided and with an output which provides a defogging nozzle connected therein in an operative relation of blanketing the cabinet glass with recycled air cleared of fog, and a source of electric power, comprising:

power lines for connection to the source of power and control switch means including operating switching circuits;

transfer switch means provided with a switch operator and included in the operating switching circuits with normally closed contacts electrically connected to one power line and connected in a load circuit to the electric hot tank for electrically heating tank liquid, and transfer contacts electrically connected to said power line and connected to the electric pump for transferring the electricity supplied in the operating switching circuits from the electric hot tank to the electric spray pump and vice versa; and remotely operated means activatable for operating the switch operator of the transfer switch means to limit peak electrical demand by respectively in activated position deenergizing the electric hot tank during the cyclically repeated temporary intervals when the spray pump is operating under power and otherwise deenergizing in deactivated position the spray pump when the electrical supply resumes through the normally closed contacts to the electric hot tank;

said safety switch having, at one side, means connecting it to deenergizably control the pump and also connecting it to the blower, and connected at the other side to a power line, and responsive to opening of the cabinet for automatic circuit interruption so as simultaneously to deenergize the electric blower and electric spray pump in a cabinet-open switch-open relation and vice versa in the cabinet-closed switch-closed relation.

2. The invention according to claim 1, further comprising:

a gang switch interposed in circuit with the safety switch at said one side which provides separate control connections to the electric blower and spray pump and which when prelinary closed at outset is thereafter effective keeping the electric blower energized at all times at which the electric spray pump is energized.

3. The invention according to claim 1, further comprising:

a spray chamber light connected, in common with the blower and with the normally closed and the transfer contacts, electrically in parallel therewith to said one power line; and a main switch included in the operating switching circuits and connected electrically in series in said one power line, and respectively closing and opening so as, simultaneously when closed, to switch-on the chamber light and electric blower and, through the normally closed contacts, switch-on the electric hot tank for heating, and vice versa when open.

4. The invention according to claim 1, further comprising:

a thermostat switch included in the operating switching circuits connected electrically in series in said load circuit with the electric hot liquid tank limiting peak electrical demand automatically in response to any hot liquid temperature while at or above a predetermined cleaning liquid value.

5. Control apparatus for a hot tank spray washer controlled for cyclically repeated temporary intervals of spray cleaning operation, and characterized by a spray chamber with a chamber access door, and with an air-blanketed viewing window thereadjacent, an electric hot liquid supply tank and an electric spray pump supplied thereby to provide hot cleaning liquid for spray washing of which a characteristic is a rising fog in the spray chamber, an electric blower with input which provides therein a fog separator and with an output which provides a window blower for delivery of a blanket of recycled air cleared of fog, and a source of electric power, comprising:

a power line for connecting to the power source and switch means including operating switching circuits;

a relay switch provided with an electrically operating relay coil and included in the operating switching circuits with normally closed contacts electrically connected in a contacts supply circuit to the power line and connected in a load circuit with connection for the electric hot tank for electrically heating tank liquid, and transfer contacts in said contacts supply circuit with connection to the power line and with connection for the electric pump for transferring the electrically to be supplied in the operating switching circuits from the electric hot tank to the electric spray pump and vice versa;

a second switch included in the operating switching circuits having circuit connections at one side connecting in respective first and second circuits each of the relay coil and electric blower, and having at the other side a connection to the power line for energizing the electric blower at all times at which the electric spray pump is energized; and a remotely operated switch included in the operating switching circuits connected electrically in series in the first circuit for electrically operating the relay coil to limit peak electrical demand by, respectively, in switch-closed position deenergizing the electric hot tank during the cyclically repeated temporary intervals when the spray pump is operating under power and, otherwise, deenergizing in switch-open position the spray pump when the electrical supply resumes through the normally closed relay contacts to the electric hot tank.

6. The invention according to claim 5, further comprising:

said second switch comprising a door switch responsive to access door operation for automatic circuit interruption so as simultaneously to deenergize the electric blower and electric spray pump in a door-open switch-open relation and vice versa in the door-closed switch-closed relation.

7. The invention according to claim 5, further comprising:

a spray chamber light connected by the contacts supply circuit electrically, and in parallel with the relay contacts, to the power line in common; and a main switch included in the operating switching circuits and connected in said power line electrically in series to said contacts supply circuit, and respectively closing and opening so as, simultaneously when closed, to switch-on the chamber light and blower and, through the normally closed relay contacts, switch-on the electric hot tank for heating, and vice versa when open.

8. The invention according to claim 5, further comprising:

a thermostat switch included in the operating switching circuits connected electrically in series in said load circuit for the electric tank limiting peak electrical demand automatically in response to hot cleaning liquid while at or above a predetermined cleaning temperature.

9. Hot tank spray washer characterized by cyclically repeated temporary intervals of spray cleaning operation, including:

a cleaning liquid recycling system comprising an electric spray pump having an inlet and a high pressure output, and a pump supply including an electric hot liquid tank connected to the pump inlet;

a cabinet comprising a spray chamber, a chamber access door thereto, glove box gloves carried by the access door to protrude into the spray chamber when the door is closed, a chamber air cleaning and recycling system including an electric blower with an output for clear air and a fog separator to which the blower is connected and through which the electric blower draws the chamber air as recycled, cleared from and ridded of spray fog picked up in the spray chamber, a chamber viewing window and a defogging nozzle in the chamber in an operative relation of impingement on the window and connected in the clear air output of the electric blower, and a glove manipulated spray nozzle in the spray chamber connected in the output of the electric spray pump;

a power source system having a power line to the source of power and switch means including operating switching circuits;

a relay switch provided with an electrically operating relay coil and included in the operating switching circuits with normally closed contacts electrically connected to the power line and connected in a load circuit to the electric hot tank for electrically heating tank liquid, and transfer contacts electrically connected to the power line and connected to the electric pump for transferring the electricity supplied in the operating switching circuits from the electric hot tank to the electric spray pump and vice versa;

a control supply line having circuit connections at one side connecting in respective first and second circuits each of the relay coil and electric blower, and at the other side providing in respect of the coil and blower a common supply connection therefor to the power line; and a remotely operated switch included in the operating switching circuits connected electrically in series in the first circuit for electrically operating the relay coil to limit peak electrical demand by respectively in switch-closed position deenergizing the electric hot tank during the cyclically repeated temporary intervals when the spray pump is operating under power and otherwise deenergizing in switch-open position the spray pump when the electrical supply resumes through the normally closed relay contacts to the electric hot tank.

10. The invention according to claim 9, further including:

a blower switch included in the operating switching circuits which is connected electrically in series in the second circuit and which when preliminarily closed at outset is thereafter effective keeping the electric blower energized at all times at which the electric spray pump is energized.

11. The invention according to claim 9, further including:

a door switch included in the operating switching circuits connected electrically in series in said common supply connection to the power line and responsive to access door operation for automatic circuit interruption so as simultaneously to deenergize the electric blower and electric spray pump in a door-open switch-open relation and vice versa in the door-closed switch-closed relation.

12. The invention according to claim 9, further including:

a spray chamber light connected, in common with the relay contacts, electrically in parallel therewith to the power line; and a main switch included in the operating switching circuits anc connected electrically in series in said power line, and respectively closing and opening so as, simultaneously when closed, to switch-on the chamber light and, through the normally closed relay contacts, switch-on the electric hot tank for heating, and vice versa when open.

13. The invention according to claim 9, further including:

a thermostat switch included in the operating switching circuits connected electrically in series in said load circuit with the electric hot liquid tank limiting peak electrical demand automatically in response to any hot liquid temperature while at or above a predetermined cleaning liquid value.

14. Hot tank spray washer characterized by cyclically repeated temporary intervals of spray cleaning operation, including:

a cleaning liquid recycling system comprising an electric spray pump having an inlet and a high pressure output, and a pump supply including an electric hot liquid tank connected to the pump inlet;

a cabinet comprising a spray chamber, a chamber access door thereto, glove box gloves carried by the access door to protrude into the spray chamber when the door is closed, a chamber air cleaning and recycling system including an electric blower with an output for clear air and a fog separator to which the blower is connected and through which the electric blower draws the chamber air as recycled, cleared from and ridded of spray fog picked up in the spray chamber, a chamber viewing window and a defogging nozzle in the chamber in an operative relation of impingement upon the window and connected in the clear air output of the electric blower, and a glove manipulated spray nozzle in the spray chamber connected in the output of the electric spray pump; and a power source system having a power line to the source of power and switch means including operating switching circuits;

a relay switch provided with an electrically operating relay coil and included in the operating switching circuits with normally closed contacts electrically connected in a contacts supply circuit to the power line and connected in a load circuit to the electric tank for electrically heating liquid in the tank, and transfer contacts connected in said contacts supply circuit to the power line and connected to the electric pump for transferring the electricity supply in the operating switching circuits from the electric tank to the electric spray pump and vice versa;

a gang switch included in the operating switching circuits having circuit connections at one side connecting in respective first and second circuits each of the relay coil and the electric blower and having at the other side a common connection to the power line for energizing the electric blower at all times at which the electric pump is energized; and a remotely operated switch included in the operating switching circuits connected electrically in series in the first circuit for electrically operating the relay coil to limit peak electrical demand by respectively deenergizing the electric tank during the cyclically repeating temporary intervals when the spray pump is operating under power and otherwise deenergizing the spray pump when the electrical supply resumes to the electric tank.

15. The invention according to claim 14, further including:

a door switch included in the operating switching circuits connected electrically in series in said common gang switch connection to the power line and responsive to access door operation for automatic circuit interruption so as simultaneously to deenergize the electric blower and electric spray pump in a door-open switch-open relation and vice versa in the door-closed switch-closed relation.

16. The invention according to claim 14, further including:

a spray chamber light connected by the contacts supply circuit electrically, and in parallel with the relay contacts, to the power line in common; and a main switch included in the operating switching circuits and connected in said power line electrically in series to said contacts supply circuit, and respectively closing and opening so as, simultaneously when closed, to switch-on the chamber light and, through the normally closed relay contacts, switch-on the electric hot tank for heating, and vice versa when open.

17. The invention according to claim 14, further including:

a thermostat switch included in the operating switching circuits connected electrically in series in said load circuit with the electric tank limiting peak electrical demand automatically in response to any hot liquid temperature while at or above a predetermined cleaning liquid value.

18. High pressure solvent spray cabinet to spray-clean parts by hand manipulation in a closed system comprising:

a fully enclosed spray chamber including a spaced apart sealed top wall structure which is relatively foreshortened and floor pan wall beneath said foreshortened structure, and continuous side walls joining same including a rear side wall, an end side wall at an end, and joined-together vertical lower and glassed, diagonally disposed, upper front panels together forming a front side wall in extent, said panels operatively arranged respectively upright transversely to the attached floor pan wall and slanting upwardly and rearwardly to a point of attachment between the upper end of the diagonal upper front panel and the relatively foreshortened top wall structure;

a work window inset in parallel in said glassed, diagonal upper front panel susceptive to condensation and overspray incident to the splash-induced fog spray accumulating to a high vapor concentration in the confined spray chamber atmosphere;

a blower-recirculated atmosphere recycling circuit effective to limit and dilute the vapor to a reduced concentration by fog-separator filtering for vapor-to-liquid agglomeration and by reintroduction for recycled continued circulation of air cleared from and ridded of fog picked up in the spray chamber;

said circuit supported on an inside surface of said chamber end wall, and including an electric blower with an output for the clear air and an input providing a fog separator;

a medially directed run of conduit connected in the blower output extending generally in parallel to, and partway of, the chamber top wall structure lengthwise; and a window blower nozzle in the output communicatively transverse to the conduit and laterally directed to impinge at an angle of incidence beginning at a top inside portion of the window inset, said nozzle thinly slotted and having sides diverging in the direction of clear air flow toward the thin slot so as to direct the latter diffused in a thin widening blanket of forced scrubbing contact transverse to the window.

19. The invention according to claim 18, characterized by:

said front side wall providing an access door into the cabinet, and including horizontal hinge means provided at the top of at least the vertical lower one of the front panels, hinging it to the bottom of the glassed panel for upswinging to an inoperative position providing an open access opening into the spray chamber.

20. The invention according to claim 19 further characterized by:

glove box gloves protruding for an arm's length into the spray chamber, said gloves moisture-proof and sealed to and supported by the lower one of the front panels for withdrawing folded out of the way attendant with upswinging movement imparted to the front end wall.

21. The invention according to claim 20 additionally characterized by:

said gloves having outwardly flaring sealed, open arm portions which convolute by telescopically inverting in their arm portions for storage, such convolutions effectively foreshortening the protruding lengths of the gloves so as to store more compactly.

22. Hot tank spray washer characterized by cyclically repeated temporary intervals of spray cleaning operation, including:

a cleaning liquid recycliing system comprising an electric spray pump having an inlet and a high pressure output, and a pump supply including an electric hot liquid tank connected to the pump inlet;

a glassed cabinet comprising a spray chamber, a chamber access door thereto, glove body gloves carried by the access door to protrude into the spray chamber when the door is closed, and a glove manipulated spray nozzle in the spray chamber connected in the output of the electric spray pump a power source system having a power line to the source of power and switch means including operation switching circuits;

a relay switch provided with an electrically operating relay coil and included in the operating switching circuits with normally closed contacts electrically connected to the power line and connected in a load circuit to the electric hot tank for electrically heating tank liquid, and transfer contacts electrically connected to the power line and connected to the electric pump for transferring the electrically supplied in the operating switching circuits from the electric hot tank to the electric spray pump and vice versa;

a relay circuit interconnecting the relay coil and power line; and a remotely operated switch included in the operating switching circuits connected electrically in series in the relay circuit for electrically operating the relay coil to limit peak electrical demand by respectively in switch-closed position deenergizing the electric hot tank during the cyclically repeated temporary intervals when the spray pump is operating under power and otherwise deenergizing in switch-open position the spray pump when the electrical supply resumes through the normally closed relay contacts to the electric hot tank.

23. The invention according to claim 22, characterized by:

said remote switch arranged to be air operated and having a floor pedal connection affording remote air operation by the washer operator;

a safety switch operating with each opening of the chamber for access and included in the relay circuit with one side connected to the relay coil and the other side connected to the power line; and a branch circuit including an air recycling blower system for the glassed cabinet and connected in circuit with the safety switch on its other side aforesaid, affording joint reaction of the blower system with the relay circuit and pump in response to operation of the safety switch.

* * * * *